United States Patent [19]

Sato

[11] Patent Number: 5,055,062

[45] Date of Patent: Oct. 8, 1991

[54] MULTICONDUCTOR CABLE CONNECTOR AND METHOD OF LOADING SAME

[75] Inventor: Kensaku Sato, Tokyo, Japan

[73] Assignee: Hirose Electric Co., Ltd., Tokyo, Japan

[21] Appl. No.: 611,422

[22] Filed: Nov. 9, 1990

[30] Foreign Application Priority Data

Nov. 17, 1989 [JP] Japan ..... 1-297713

[51] Int. Cl.[5] ..... H01R 4/24

[52] U.S. Cl. ..... 439/395; 439/607

[58] Field of Search ..... 439/389–425, 439/607–610

[56] References Cited

U.S. PATENT DOCUMENTS

| | | | |
|---|---|---|---|
| 3,329,925 | 7/1967 | Johnson et al. | 439/610 |
| 4,111,613 | 9/1978 | Thurston et al. | 439/610 |
| 4,641,906 | 2/1987 | Olsson | 439/610 |
| 4,666,227 | 5/1987 | Galizia et al. | 339/64 M |
| 4,671,599 | 6/1987 | Olsson | 439/610 |
| 4,790,775 | 12/1988 | David | 439/579 |

*Primary Examiner*—Joseph H. McGlynn
*Attorney, Agent, or Firm*—Kanesaka & Takeuchi

[57] ABSTRACT

An electrical connector for a shielded multiconductor cable, which includes a shielding case (3) including a contact retention portion (6) with at least one jig inlet (11) formed on a bottom face thereof, a shield wires crimping portion (7) with crimping tabs for crimping shield wires of the multiconductor cable, and an outer sheath crimping portion (8) with crimping tabs for crimping an outer sheath of the multiconductor cable; an insulator body (4) provided within the contact retention portion; and at least one signal contact (5) having a contact body (14), a signal line crimping portion (15) with crimping tabs for crimping a signal line of the multiconductor cable, and an insulator crimping portion (16) with crimping tabs for crimping an intermediate insulator of the multiconductor cable and supported by the insulation body such that the signal line and intermediate insulator crimping portions are positioned above the jig inlet.

3 Claims, 4 Drawing Sheets

MULTICONDUCTOR CABLE CONNECTOR AND METHOD OF LOADING SAME

BACKGROUND OF THE INVENTION

1. Field of the Invention

The present invention relates to electrical connectors for shielded multiconductor cables of electronic equipment in automobiles, for example, and methods of loading such a multiconductor cable on the electrical connector.

2. Description of the Prior Art

FIG. 9 shows a conventional shielded cable connector which is connected by stripping a length of outer sheath g from a shielded cable a, separating shield wires b from a signal line c, bundling and connecting the shield wires b to the contact terminal e of a connector body d while connecting the signal line c to the contact terminal f by insulation displacing technique, for example.

However, in the above connector, it has been necessary to connect separately the shield wires b and the signal line c to the contact terminal e and the contact terminal f, respectively. Since multiconductor cables have a number of signal lines c, it has been very difficult to streamline and automate the connection operation. In addition, the shield wires were removed adjacent the connector body d, the signal lines c have had no shielding protection in the area.

SUMMARY OF THE INVENTION

Accordingly, it is an object of the invention to provide a multiconductor cable connector which has an excellent shielding effect and permits continuous and automatic crimping of a great number of signal lines, shield wires, and outer sheaths to the electrical connector.

It is another object of the invention to provide a method of loading a multiconductor cable on such an electrical connector as described above.

According to one aspect of the invention there is provided an electrical connector for a shielded multiconductor cable, which includes a shielding case including a contact retention portion with at least one jig inlet formed on a bottom face thereof, a shield wires crimping portion with crimping tabs for crimping shield wires of the multiconductor cable, and an outer sheath crimping portion with crimping tabs for crimping an outer sheath of the multiconductor cable; an insulator body provided within the contact retention portion; and at least one signal contact having a contact body, a signal line crimping portion with crimping tabs for crimping a signal line of the multiconductor cable, and an insulator crimping portion with crimping tabs for crimping an intermediate insulator of the multiconductor cable and supported by the insulation body such that the signal line and intermediate insulator crimping portions are positioned above the jig inlet.

According to another aspect of the invention there is provided a method of loading a shielded multiconductor cable on the electrical connector of claim 1, which includes the steps of placing a prepared end portion of the multiconductor cable on the shielding case such that the signal line, shield wires, and outer sheath are placed on the respective crimping tabs; and pressing the respective crimping tabs either successively or simultaneously onto the signal line, shield wires, and outer sheath by means of crimping jigs for effecting connection.

With the electrical connector according to the invention, since the stripped end portion of a multiconductor cable is simply placed on the contact terminal such that the signal lines, shield wires, and outer sheath are placed on the respective crimping tabs, which are then pressed to make connection by means of crimping jig, automatic continuous connection of a great number of electrical connectors is possible. The shield case covers the signal lines and signal line contacts, providing an excellent shielding effect.

The above and other objects, features, and advantages of the invention will be more apparent from the following description when taken in conjunction with the accompanying drawings.

DESCRIPTION OF THE PREFERRED EMBODIMENT

Figure 1:
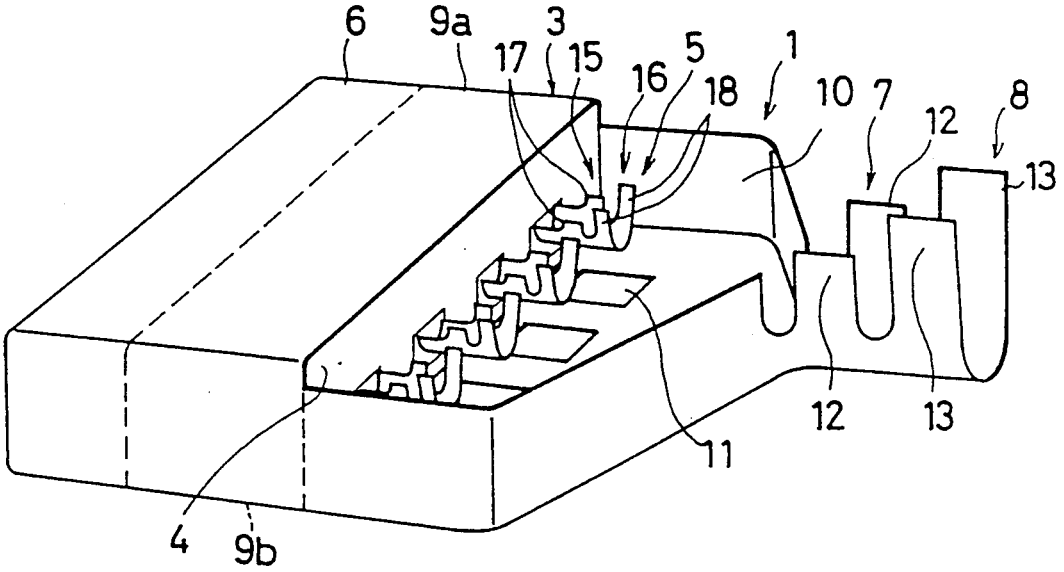
FIG. 1 is a perspective view of an electrical contact terminal according to an embodiment of the invention.
Figure 2:
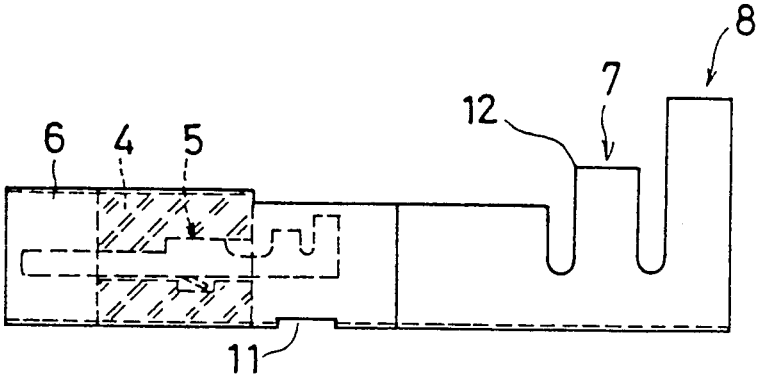
FIG. 2 is a side elevation thereof.
Figure 3:
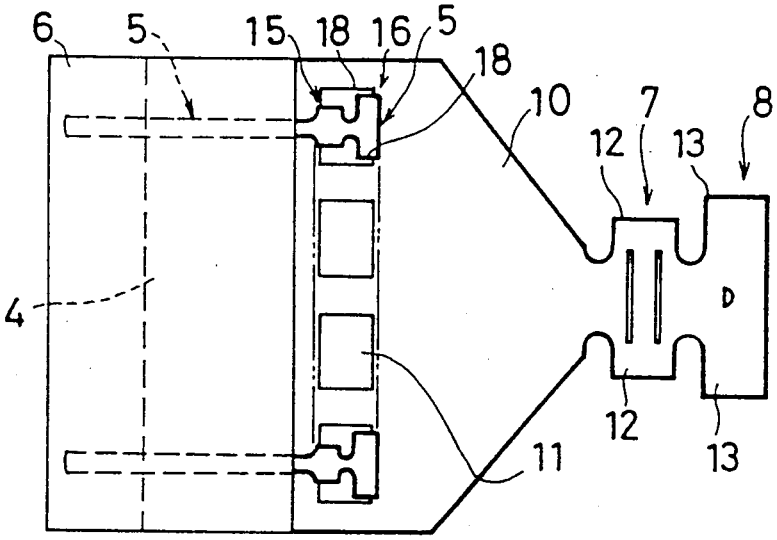
FIG. 3 is a top plan view thereof.
Figure 4:
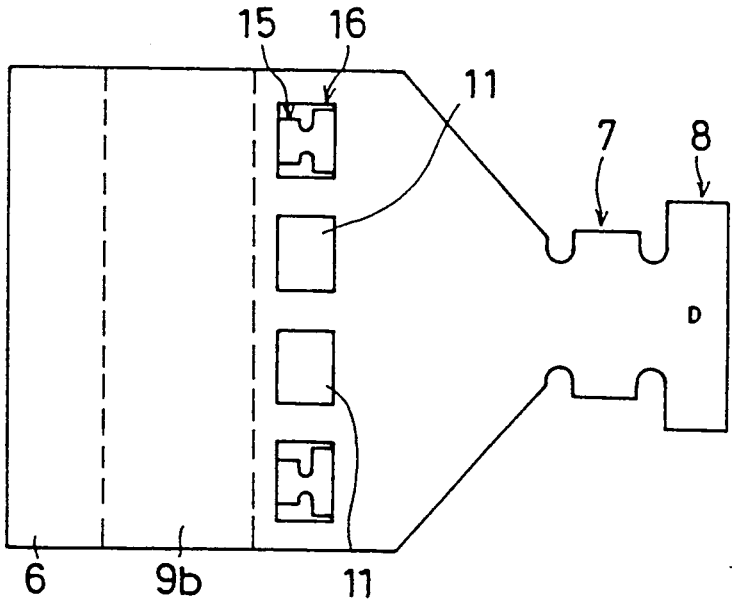
FIG. 4 is a bottom plan view thereof.

FIGS. 1–4 show a multiconductor cable connector according to an embodiment of the invention. The connector includes an electrical contact terminal 1 within a housing (not shown). The contact terminal 1 includes a shielding case 3, an insulation body 4, and four signal lines contacts 5 in this embodiment. The shielding case 3 is divided into three portions; a contact retention portion 6 with a rectangular cross-section, a shield wires (outer conductor) crimping portion 7, and an outer sheath retention portion 8. An opening 10 extends rearwardly from the rear edge of a top face 9*a* and serves as a jig inlet. Jig inlets 11 equal in number to the signal line contacts 5 are formed at predetermined intervals across the bottom face 9*b* of the contact retention portion 6. The shield wires crimping portion 7 has a pair of U-shaped crimping tabs 12, while the outer sheath retention portion 8 has a pair of U-shaped crimping tabs 13 which are larger than the crimping tabs 12.

Figure 5:
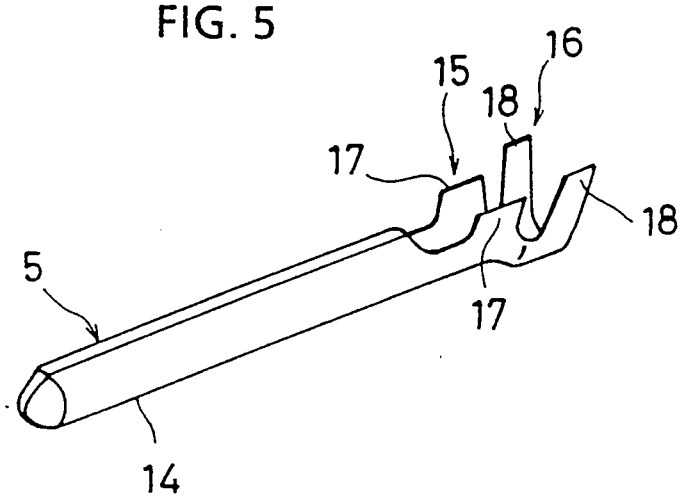
FIG. 5 is a perspective view of a signal line contact according to an embodiment of the invention.

As FIG. 5 shows, the signal line contact 5 has a contact body 14, a signal line crimping portion 15, and an insulator crimping portion 16. The contact body 14 takes the form of a pin, while the signal line crimping portion 15 has a pair of U-shaped crimping tabs 17. The insulator crimping portion 16 also has a pair of U-shaped crimping tabs 18. The signal line contact 5 is supported within the contact retention portion 6 via the insulator body 4 to make an electrical contact terminal 1 such that the respective crimping tabs 17 and 18 extending upwardly are positioned above the jig inlets 11.

Figure 6:
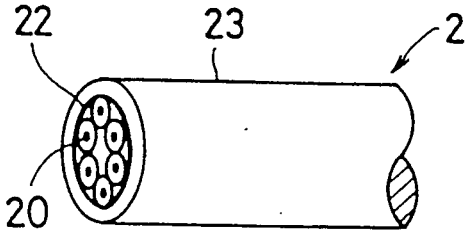
FIGS. 6(*a*), (*b*), and (*c*) illustrate how to prepare an end portion of a multiconductor cable.
Figure 6:
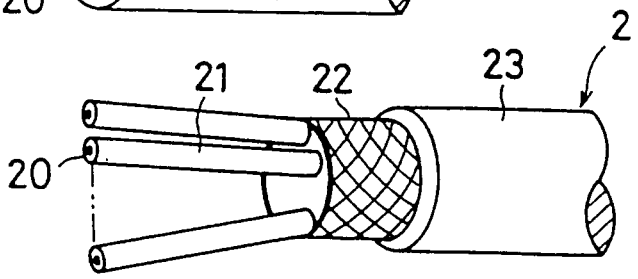
Figure 6:
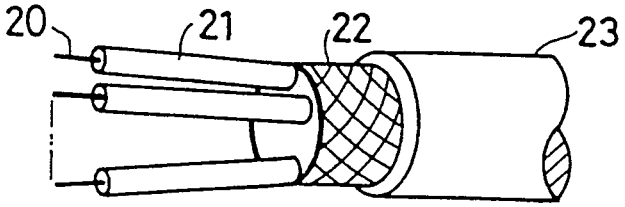

In order to connect a shielded cable 2 to the electrical contact terminal 1, first of all, as FIGS. 6(*a*), (*b*), and (*c*) show, a length of outer sheath 23 is removed from the shielded cable 2 to expose the signal lines (central conductors) 20, the intermediate insulator 21, and the shield wires (outer conductor) 22. The prepared shielded cable 2 is placed on the electrical contact terminal 1 so that the individual signal lines 20, the intermediate insulators 21, the shield wires 22, and the outer sheath 23 are placed on the corresponding crimping tabs 17, 18, 12, and 13, respectively.

Figure 7:
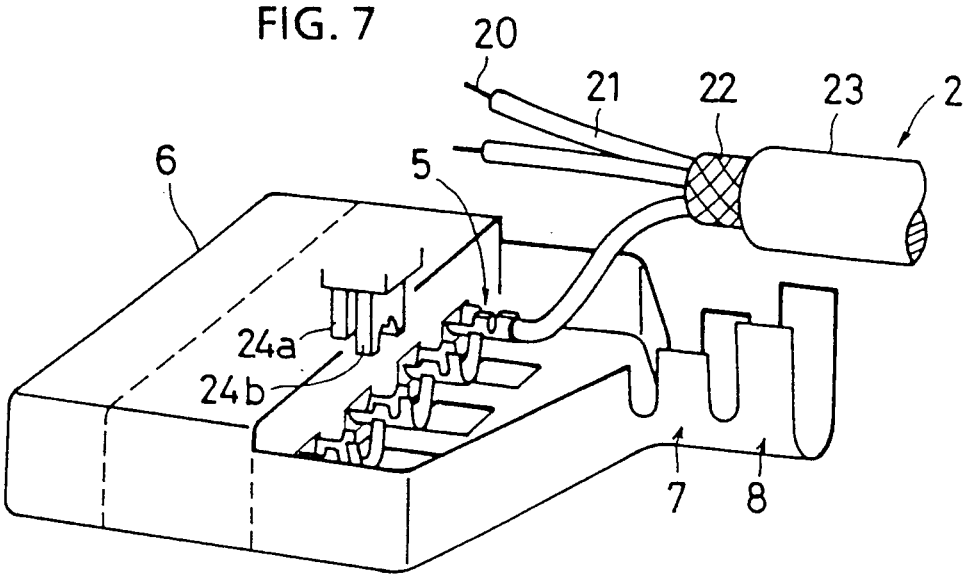
FIG. 7 illustrates how to crimp the signal lines of a multiconductor cable to the signal line contacts.

As FIG. 7 shows, the crimping tabs 17 and 18 of the signal line contact 5 are crimped to the signal line 20 and the intermediate insulator 21, respectively, by means of anvils 24*a* and 24*b* and crimpers 25*a* and 25*b*.

Figure 8:
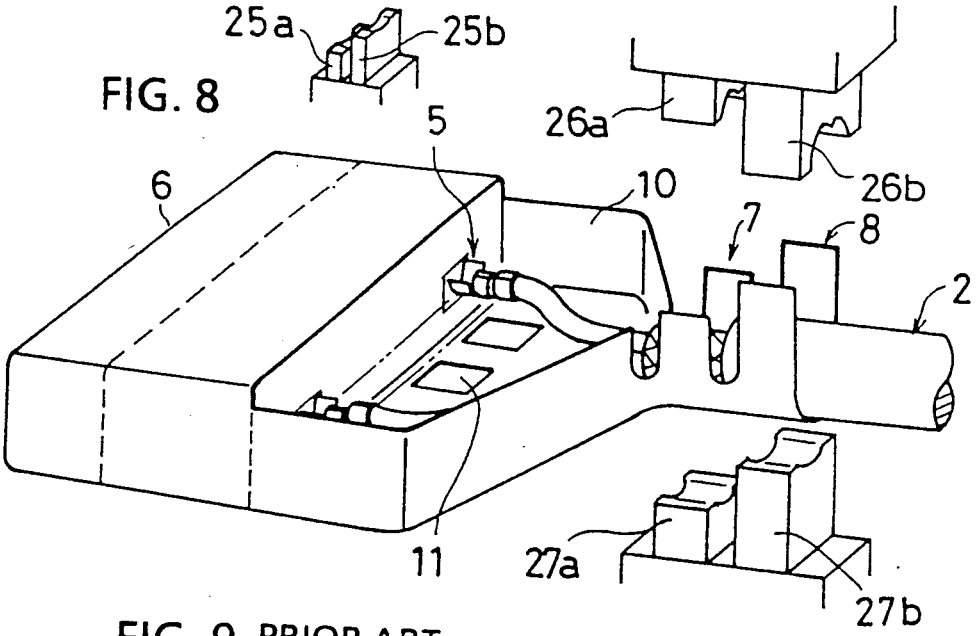
FIG. 8 illustrates how to crimp the multiconductor cable to the shielding case.
Figure 9:
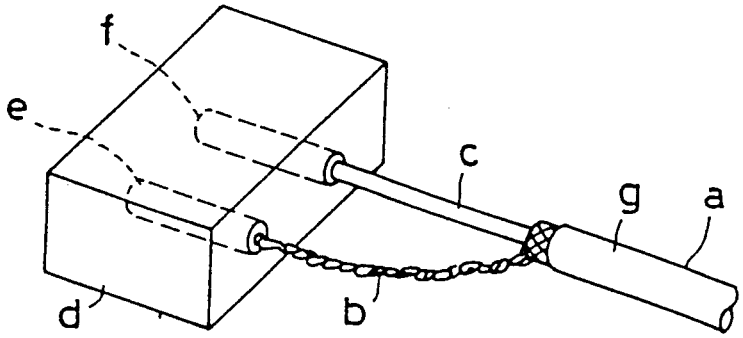
FIG. 9 PRIOR ART
FIG. 9 is a perspective view of a conventional electrical connector.

As FIG. 8 shows, the crimping tabs 12 and 13 of the shielding case 3 are crimped to the shield wires 22 and the outer sheath 23, respectively, by means of anvils 26*a* and 26*b* and crimpers 27*a* and 27*b*.

More specifically, the anvils 24*a* and 24*b* are inserted through the jig inlet 10 while the crimpers 25*a* and 25*b* are inserted through the jig inlets 11 to press the crimping tabs 17 and 18 onto the signal lines 20 and the intermediate insulators 21, respectively, for effecting connection. Then, the anvils 26*a* and 26*b* and the crimpers 27*a* and 27*b* are operated to press the crimping tabs 12 and 13 onto the shield wires 22 and the outer sheath 23, respectively, for connecting the shielded cable 2 to the electrical contact terminal 1. The contact terminal 1 is then provided with an insulation cover (not shown) to make a finished connector.

Alternatively, the anvils 26*a* and 26*b* and the crimpers 27*a* and 27*b* may be operated simultaneously with the anvils 24*a* and 24*b* and the crimpers 25*a* and 25*b*.

As has been described above, with the electrical contact terminal according to the invention, it is easy to connect a multiconductor cable to the electrical contact connector by simply placing the multiconductor cable on the contact terminal so that the signal lines, shield wires, and outer sheath are placed on the respective crimping tabs and pressing these tabs by means of anvils and crimpers through the jig inlets. This makes possible continuous and automatic connection of a large number of multiconductor cables, and thus considerable reduction in the manufacturing costs. In addition, the signal lines and the signal line contacts are covered by the shielding case, resulting in the enhanced shielding effect.

I claim:

1. An electrical connector for a shielded multiconductor cable, comprising:

a shielding case including a contact retention portion with at lease a pair of jig inlets formed on a top and a bottom face thereof, a shield wires crimping portion with crimping tabs for crimping shield wires of said multiconductor cable, and an outer sheath crimping portion with crimping tabs for crimping an outer sheath of said multiconductor cable;

an insulator body provided within said contact retention portion; and at least one signal contact having a contact body, a signal line crimping portion with crimping tabs for crimping a signal line of said multiconductor cable, and an insulator crimping portion with crimping tabs for crimping an intermediate insulator of said multiconductor cable and supported by said insulation body such that said signal line and intermediate insulator crimping portions are positioned between said jig inlets.

2. A method of loading a shielded multiconductor cable on said electrical connector of claim 1, which comprises the steps of:

placing a prepared end portion of said multiconductor cable on said shielding case such that said signal line, shield wires, and outer sheath are placed on said respective crimping tabs; and pressing said respective crimping tabs either successively or simultaneously onto said signal line through said jig inlets for effecting connection.

3. An electrical connector for a shielded multiconductor cable, comprising:

a shielding case including a rectangular cubic contact retention portion having a top wall, a bottom wall, and a pair of opposed side walls and a rear portion having a bottom wall and a pair of side wall to define an opening for receiving insulated conductors of said shielded multiconductor cable; said rear portion having at least one jig inlet formed on said bottom wall thereof in the vicinity of said contact retention portion;

a rectangular cubic insulator body fitted in said contact retention portion; and at least one signal contact having a contact body, a U-shaped signal line crimping portion to be crimped to a signal line of said multiconductor cable, and a U-shaped insulator crimping portion to be crimped to an intermediate insulator of said multiconductor cable, said signal contact being supported by said insulation body such that said signal line and intermediate insulator crimping portions project into said opening and positioned above said jig inlet.

* * * * *